US005899270A

United States Patent [19]

Watson

[11] Patent Number: 5,899,270

[45] Date of Patent: May 4, 1999

[54] SIDE INTAKE VALVE ASSEMBLY

[75] Inventor: Brock W. Watson, Longview, Tex.

[73] Assignee: Dresser Oil Tools Division of Dresser Industries, Inc., Dallas, Tex.

[21] Appl. No.: 08/835,654

[22] Filed: Apr. 10, 1997

Related U.S. Application Data

[60] Provisional application No. 60/018,257, May 24, 1996.

[51] Int. Cl.[6] ..... E21B 43/00

[52] U.S. Cl. ..... 166/105.5; 166/106; 166/169; 166/110

[58] Field of Search ..... 166/325, 265, 166/105.5, 106, 169, 306, 110, 269

[56] References Cited

U.S. PATENT DOCUMENTS

| | | | |
|---|---|---|---|
| 3,167,125 | 1/1965 | Bryan | 166/45 |
| 4,241,787 | 12/1980 | Price | 166/265 X |
| 5,127,457 | 7/1992 | Stewart et al. | 166/279 X |
| 5,176,216 | 1/1993 | Slater et al. | 166/105.5 |
| 5,309,998 | 5/1994 | Rivas et al. | 166/265 |
| 5,425,416 | 6/1995 | Hammeke et al. | 166/105.5 |
| 5,497,832 | 3/1996 | Stuebinger et al. | 166/369 |

*Primary Examiner*—Roger Schoeppel
*Attorney, Agent, or Firm*—Jones, Day, Reavis & Pogue

[57] ABSTRACT

A side intake valve assembly for use in a subterranean well in conjunction with a second or lower valve assembly, and a hollow connecting body for connecting the side intake valve assembly and the second or lower valve assembly. The side intake valve assembly allows water separated from the production fluid to be forced downwardly through the intake valve assembly and the second or lower valve assembly into a water disposal zone. A one-way valve in the side intake valve assembly is a gravity operated ball valve.

15 Claims, 2 Drawing Sheets

SIDE INTAKE VALVE ASSEMBLY

CROSS-REFERENCE TO RELATED APPLICATIONS

This application claims the benefit of commonly assigned provisional patent application Serial No. 60/018,257 filed May 24, 1996 now abandoned.

BACKGROUND OF THE INVENTION

1. Field of the Invention

The present invention relates in general to apparatus for use in subterranean wells that produce hydrocarbon fluids such as gas and oil and in particular to a side intake valve assembly that accepts water from a producing zone that has been separated from hydrocarbon fluids and enables the hydrocarbon fluid to be pumped to the surface and forces the water that is produced from the producing zone into a disposal zone downhole such that the water does not have to be pumped to the surface.

2. Description of Related Art Including Information Disclosed Under 37 CFR 1.97 and 1.98

Hydrocarbon fluids are found in subterranean layers that are reached with wells drilled from the surface down through the layers of interest. The layers may contain hydrocarbon fluids such as gas and oil that are desired to be produced to the surface. They also produce water which, when having to be pumped to the surface, requires a great deal of energy that is wasted inasmuch as the water cannot be used.

The wells are encased with a heavy steel pipe that is usually cemented in place so that the fluids cannot escape or flow along the space between the casing and the borehole wall.

In the prior art, in some instances, the water produced is separated downhole in the casing from the hydrocarbon fluids. The mixture of the hydrocarbon fluids and water flows through perforations of the casing wall from a production zone into the interior thereof where the hydrocarbon fluid floats on top of the water inasmuch as it is lighter than the water. A water disposal zone may be located at a distance beneath the production zone. A pump may be installed downhole so that the separated water may be forced into the lower water disposal zone. Such a system is disclosed in U.S. Pat. No. 3,167,125. In that patent, there is formed a seal inside the casing between an upper production layer and a lower water disposal layer or area. The heavier unwanted water and the hydrocarbons stratify in the well casing. Thus the water that is separated from the hydrocarbon is pumped downwardly into the water disposal layer. A production tubing string extends downwardly through the well casing and the seal or packer, well known in the art, is placed between the production zone and the water disposal zone to separate the two zones in a fluid-tight relationship. The separated hydrocarbons are pumped to the surface through the production tubing string while the separated water in the production tubing string is forced downwardly below the packer and out into the water disposal zone.

In U.S. Pat. No. 5,176,216, a subterranean tool is disclosed in the form of a bypass tool and is positioned between a producing zone and a lower water disposal zone. The hydrocarbon in the form of a gas is produced upwardly through the annulus between the tubing and the casing and the salt water flows down through a longitudinal tube in a sleeve so that it can be disposed in the lower disposal zone.

In U.S. Pat. No. 5,497,832, a system is disclosed for improving the economics of production by reducing lifting costs of a producing well by utilizing the upstroke of a pump to produce a fluid mixture of primarily oil with only a fraction of the produced water and using the downstroke to inject the remaining produced water beneath a packer into a lower formation.

These prior art systems generally use spring-loaded valves wherein the springs assist in the opening and the closing of the valves. The environment in which these springs are used include high temperatures, corrosive well fluids, and great depths at which the valves operate. Such an environment creates problems that must be periodically addressed such as replacing the springs which requires the pulling of the production tubing string from the well casing, a very expensive and time-consuming process.

Further, some prior art valve systems are located on the outside of the production tubing string. This causes a greater outside diameter of the tubing string and thus a greater diameter well casing. Also, side forces on the tubing string can damage such side intake valve assembly.

It would be ideal to have a valve system mounted on the inside of the production tubing string instead of the outside to conserve downhole space and protect the valve from damage that can occur when it is mounted on the outside of the production tubing string. Further, such valve system should not require springs or other resilient mechanical devices to assist in opening and closing the valve.

SUMMARY OF THE INVENTION

The present invention relates to a side intake valve assembly for use in a subterranean well having a well casing and a production tubing string within the well casing that forms an annulus for receiving a production fluid including a hydrocarbon fluid and water from a production stratum and having a water disposal stratum located below the production stratum and a pump associated with the production tubing string for pumping hydrocarbon fluid from the production stratum to the surface and forcing water downwardly to the water disposal stratum. The novel side intake valve assembly involves only a water disposal assembly although it is used with a lower valve assembly both of which assemblies are of the same outside diameter and are coupled together by a hollow connecting body that also has the same outside diameter.

The valve assembly is so constructed that water, separated by gravity from the production fluids from the production stratum and accumulating in the well annulus, enters the side intake valve assembly through a side port and passes upwardly through a springless one-way caged ball valve in the valve assembly to the interior of the production casing. As stated earlier, because the hydrocarbons fluids in the well casing are lighter than water, they automatically physically separate with the hydrocarbons on the top. A pump then forces these fluids to the surface. In the typical assembly, when the pump has moved a sufficient amount of hydrocarbons, it then reverses pressure and forces the water downwardly in the tubing production string. It passes through at least one longitudinal passageway extending from the upper end to the lower end of the valve assembly such that water above the upper end of the valve assembly can be transferred below the lower end of the valve assembly and below a packer assembly in the well casing annulus to transfer the water to a lower formation.

Thus, it is an object of the present invention to provide a side intake valve assembly for drawing water from the well casing annulus to the interior of the production tubing string.

It is another object of the present invention to provide a side intake valve assembly in which the valve assembly includes a one-way check valve that does not require any mechanical assistance in maintaining the valve closed.

It is still another object of the present invention to provide a side intake valve assembly in which the valve is a caged ball assembly that operates under gravity to hold the valve in the closed position.

Thus, the present invention relates to a side intake valve assembly for use in a subterranean well having a well casing and a production tubing string within said well casing that forms an annulus for receiving a production fluid including a hydrocarbon fluid and water from a production stratum and having a water disposal stratum below the production stratum and a pump associated with the production tubing string for pumping the hydrocarbon fluid from the production stratum upwardly to the surface and the water downwardly to the water disposal stratum. The side intake valve assembly is located entirely on the inside of a housing coupled to the production tubing string and is positioned in the area of water contained in the annulus. The valve assembly comprises a housing including an upper end and a lower end, a one-way ball cage valve located between the upper and the lower end, a fluid intake body coupled to the lower end of the housing and having a side intake port in fluid communication with only the water in the annulus such that the water can be pumped from the annulus through the first one-way ball cage valve for disposal below a packer. At least one longitudinal passageway is formed in the housing and couples water from above the upper end of the valve to an area below the packer such that water above the packer can be transferred to the area below the packer.

BRIEF DESCRIPTION OF THE DRAWINGS

These and other features of the present invention will be more fully disclosed when taken in conjunction with the following DETAILED DESCRIPTION OF THE PREFERRED EMBODIMENT in which like numerals represent like elements and in which.

DETAILED DESCRIPTION OF THE PREFERRED EMBODIMENT

Figure 1:
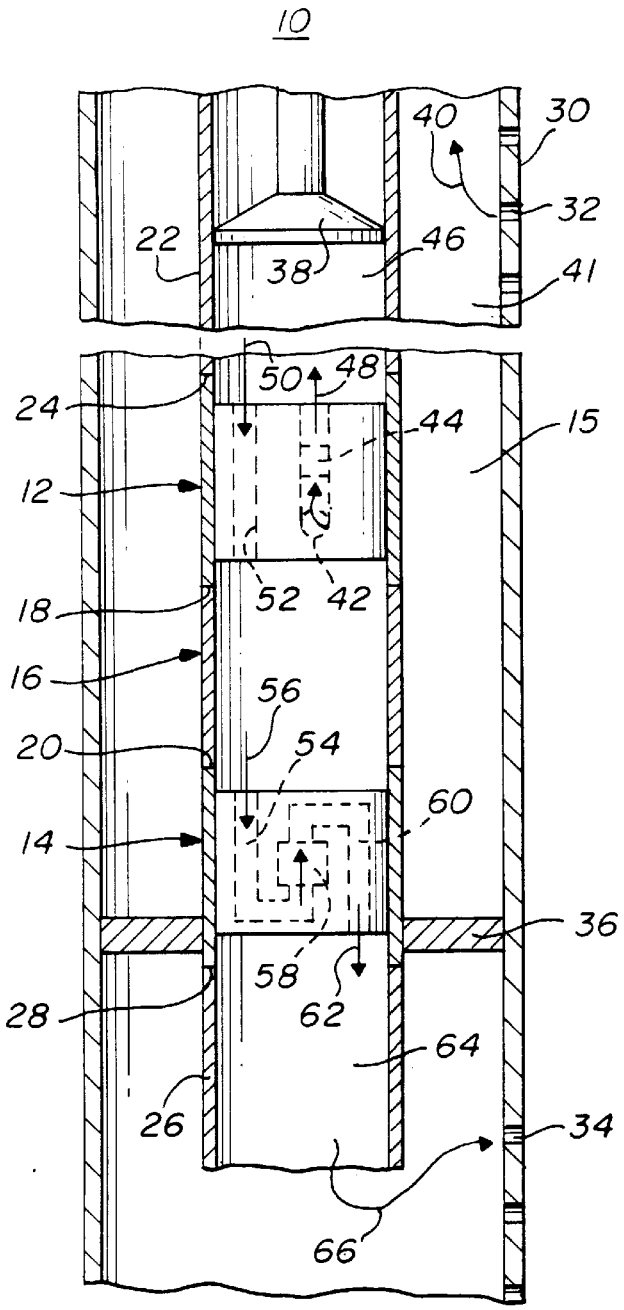
FIG. 1 is a schematic cross section of a well casing illustrating the novel side intake valve assembly therein.

FIG. 1 is a schematic representation of a section 10 of well casing and the production tubing containing the novel side intake valve assembly of the present invention used in its subterranean well environment. In FIG. 1, the section 10 is comprised of a novel side intake or first valve assembly 12 that is used in conjunction with a second valve assembly 14 and a connector housing 16 that couples the lower end of the first valve assembly 12 at 18 to the upper end of the second valve assembly 14 at 20. It will be noted that the first valve assembly 12, the second valve assembly 14, and the connector housing 16 all have the same outside diameter. Tubing drill string 22 is connected at 24 to the upper end of the first valve assembly 12. Housing 26 is coupled at 28 to the lower end of the second valve assembly 14.

The side intake valve assembly 12 is mounted in a subterranean well having a well casing 30. The well casing 30 has perforations 32 next to a production stratum for producing hydrocarbon fluids and water and a lower set of orifices 34 next to a water stratum. A packer assembly 36, well known in the art, is utilized in the annulus between the side intake valve assembly 12 and the well casing 30 to separate the production stratum zone from the water stratum or zone adjacent orifices 32 and 34, respectively.

A pump 38, well known in the art, and of various types, is located in tubing production string 22 above first valve assembly 12. When it is operated to cause production fluid to move upwardly in tubing string 22, the production fluid in the annulus 41 is conducted along path 40 in a well-known manner and passes through a one-way check valve (not shown) into the interior 46 of the production tubing string 22 above first valve assembly 12.

It is well known that the production hydrocarbon fluids, such as oil and gas, are lighter than water and thus the two naturally separate in the annulus 41 with the hydrocarbon fluids on the top and the water zone 15 at a lower level in the vicinity of valve assembly 12. Thus the hydrocarbons are pulled by the pump 38 into the interior 46 of the production string 22 in a well-known manner in an area of production string 22 well above the valves 12 and 14, not shown. Simultaneously, when the separated water at the lower level is pulled into the interior area 46 in the production string 22, through orifice 42 into side intake check valve assembly 12 from the water zone 15, the pump 38 then reverses and forces the water downwardly. Since the one-way check valve 44 will not allow fluid passage in a downward direction, the fluid is forced through longitudinal passageway 52 in the direction of arrow 50 into the interior of the production string below first or side intake valve assembly 12. It continues to be forced in the direction of arrow 56 to valve assembly 14 through passageway 54 that is coupled to the bottom of another one-way check valve 58 that passes fluid only in the direction of the arrow shown therein. The water continues through the check valve 58 and passageway 60 in the direction of arrow 62 into the bottom area 64 of the bottom housing 26. The water flows below the packer 36 and follows the direction of arrow 66 to the orifices 34 and back to the water stratum or zone adjacent thereto. Thus the hydrocarbon fluid such as oil or gas is pumped to the surface while the water is maintained downhole and thus the cost of lifting the water to the surface is eliminated.

It can readily be seen from the drawing that when pump 38 is pulling production fluids upwardly into the interior 46 of tubing production string 22, that water from area 64 below the second lower valve assembly 14 cannot pass upwardly through passage 60 since check valve 58 is a one-way check valve that will allow passage only in the opposite direction. Thus the hydrocarbon fluids are effectively maintained separate from the water.

Figure 2:
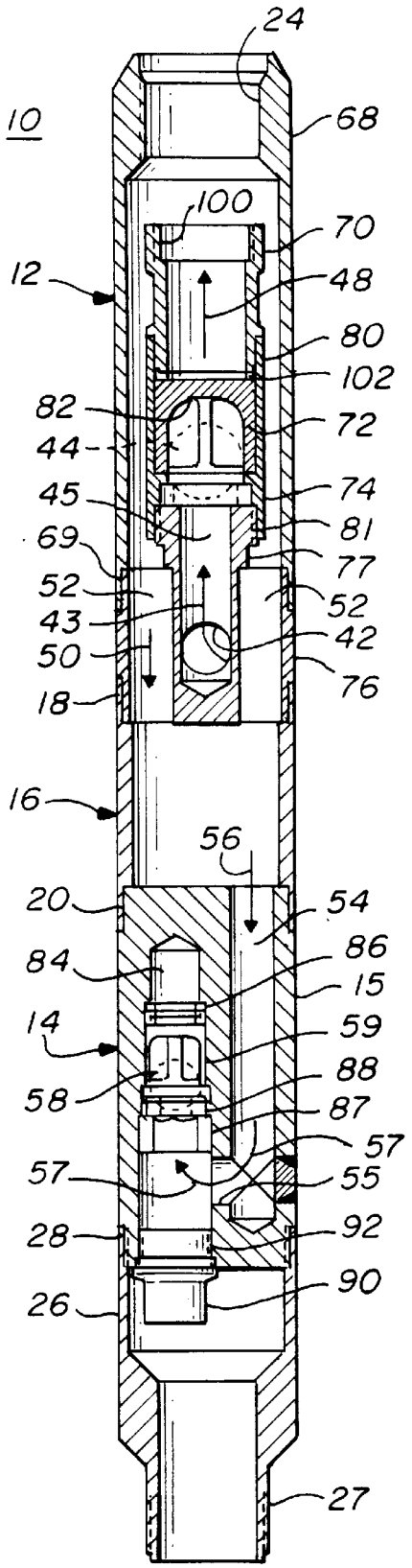
FIG. 2 is a detailed cross-sectional view of a valve assembly including the novel side intake valve assembly body portion associated with a second lower valve assembly and a connecting body.

FIG. 2 is a longitudinal or vertical cross-sectional view of the entire section 10 including side intake valve assembly 12. It can be seen that the novel first or side intake valve assembly 12 is coupled to the second lower valve assembly 14 by means of the connecting body 16 with threaded ends at 18 and 20.

First valve assembly 12 includes an upper coupling 68 having interior threads 24 on the upper end thereof for coupling to the tubing string 22 illustrated in FIG. 1. It is also attached to side intake body 76 with lower threads 69. An adapter bushing 70 is a well-known bushing threadedly coupled at 80 to the upper end of ball cage body 74 to hold the cage insert 72 in the ball cage body 74. Ball cage insert 72 is held between the adapter bushing 70 and the upper ball cage body 74. The side intake body 76 has an upper portion 77 threadedly attached at 81 to the lower end of the upper ball cage body 74.

In operation, water enters side orifice 42 in the side intake body 76 and follow the direction of arrow 43 through ball valve 44. The ball 44 is held against its valve seat solely by gravity. When fluid under pressure in the direction of arrow 43 engages the ball 44, it lifts it up in the ball cage insert 72 towards the top 82 and allows fluid to pass around it in the direction of arrow 48 towards the interior of the production string 22 as shown in FIG. 1. When the pump stops pumping and reverses the pressure, the ball 44 is seated against the valve seat as shown in phantom lines and thus closes the valve for any fluid flow downwardly therethrough. However, the water does flow down the sides of the adapter bushing, the ball cage insert and through passages 52 on each side of the side intake body 76 as shown in the direction of arrows 50. Thus the water can enter the interior of the connecting body 16. The second lower valve assembly 14 is attached to the bottom housing assembly 26 by means of threads 28 and functions as is well known in the art to allow the water to be transferred below packer 36. Thus, water in the connecting body 16 above the second or lower valve assembly 14 can be transferred to the water disposal stratum or zone below the packer 36 shown in FIG. 1 but water cannot be transferred from the water disposal stratum or zone below the packer 36 shown in FIG. 1 to the upper end of housing 15 having threads 20.

Figure 3:
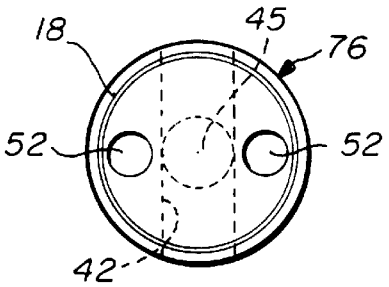
FIG. 3 is a bottom view of the novel side intake body portion used in the valve assembly.

FIG. 3 is a bottom view of the side intake body 76 shown in FIG. 2. As can be seen, it includes a central orifice 45 that is coupled to the side intake openings 42 shown in phantom lines. Side intake body 76 is a water intake body that is coupled to the lower end of the first housing by means of threads 69 as explained previously and has the side intake port 42 in fluid connection with the water in the annulus 41 shown in FIG. 1 such that water can be pumped from the annulus 31 through the first one-way valve 44 for disposal. Longitudinal passageways 52 in the side intake body extend from the upper end to the lower end such that water above the first housing or above the side intake body 76 can be transferred through the passageways 52 into the interior of the connecting body 16 below the side intake body 76.

Figure 4:
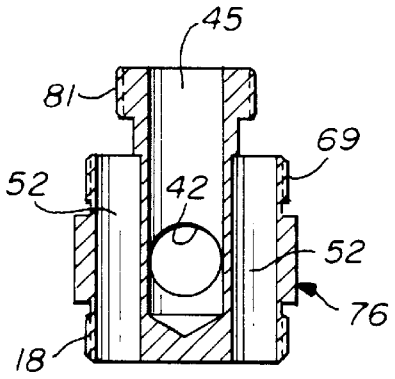
FIG. 4 is a vertical cross-sectional view of the novel side intake body portion.

FIG. 4 is a cross-sectional view of the side intake body 76 shown in detail. It shows the upper threads 81 for attaching to the lower end of the upper ball cage insert 74, the upper threads 69 for attaching to the lower end of the upper coupling 68, and the lower threads 18 for attaching to the upper end of the connecting body 16.

Figure 5:
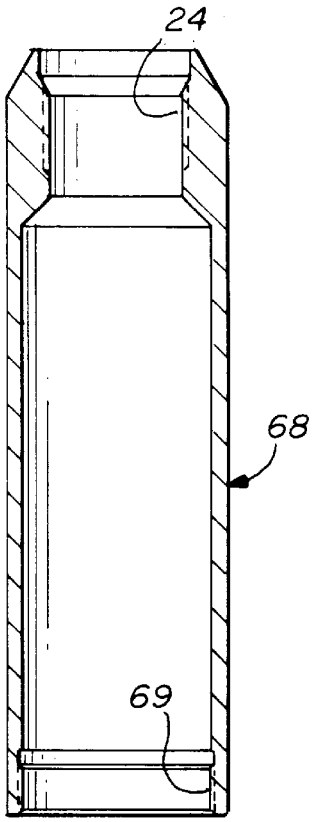
FIG. 5 is a vertical cross-sectional view of the upper coupling for the first valve assembly that connects at its upper end to the drill production tubing string and at its lower end to the side intake body.

The details of the upper coupling 68 are illustrated in FIG. 5. The upper coupling is simply a hollow body having internal threads 24 on the upper end thereof for connecting to the tubing drill string. At the lower end are internal threads 69 for threaded attachment to corresponding threads 69 on the side intake body 76 as shown in FIG. 2 and FIG. 4.

Figure 7:
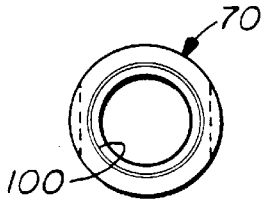
FIG. 7 is an end view of the adapter bushing shown in FIG. 10.
Figure 6:
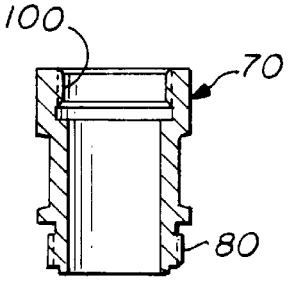
FIG. 6 is a vertical cross-sectional view of the adapter bushing for the ball cage body used in the side intake body portion.

The adapter bushing 70 for the cage insert is illustrated in FIGS. 6 and 7. FIG. 6 is a cross-sectional view of the insert cage adapter bushing 70 and illustrates the external threads 80 on one end for threaded attachment to the upper ball cage body 74 as shown in FIG. 2. Internal threads 100 on the other end are used for other purposes when the bushing 70 is used elsewhere. A coupler 102 is shown in FIG. 2 matingly attaching the adapter bushing 70 to the ball cage insert 72 as illustrated in FIG. 2. FIG. 7 is an end view of the adapter bushing 70.

Figure 9:
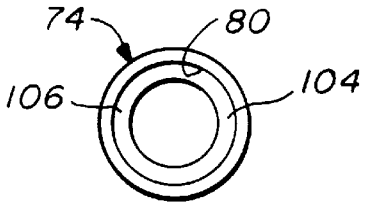
FIG. 9 is an end view of the upper ball cage body shown in FIG. 8.
Figure 8:
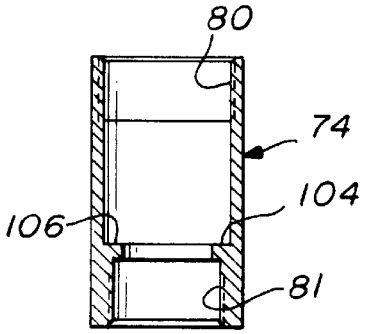
FIG. 8 is a vertical or longitudinal cross-sectional view of the upper ball cage body.

FIGS. 8 and 9 are cross-sectional views and end views, respectively, of the upper ball cage body 74. It is the device that holds the ball cage insert 72 illustrated in FIG. 2. It has threads 80 on the internal upper end thereof for attachment to the adapter bushing 70 and internal threads 81 on the lower end thereof for threadable attachment to the mating threads on the external upper end 77 of the side intake body 76. Shoulders 104 and 106 on the interior of the upper ball cage body 74 receive the ball cage insert 72 shown in FIG. 2 and in FIGS. 10 and 11. FIG. 9 is the end view illustrating the shoulders 104 and 106 in FIG. 8 which, in fact, as shown in FIG. 9, is simply a circular ledge that extends around the interior periphery of the upper ball cage body 74.

Figure 10:
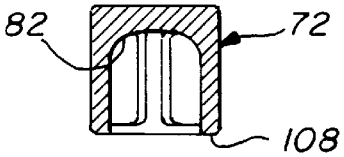
FIG. 10 is a vertical or longitudinal cross-sectional view of the ball cage insert used in the first or side intake valve assembly.
Figure 11:
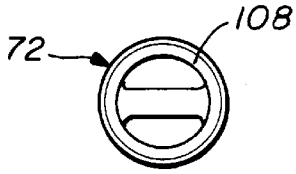
FIG. 11 is an end view of the ball cage insert illustrated in FIG. 10.

The ball cage insert 72 itself is illustrated in FIGS. 10 and 11 as cross-sectional views and end views, respectively. As can be seen in FIG. 10 and as explained earlier in relation to FIG. 2, the upper end 82 of the ball cage insert 72 limits the upward movement of the ball 44 in the ball cage body 74. By moving upwardly, the ball moves off of the valve seat and allows fluid flow through the ball cage in one direction. When the pressure is from the opposite direction, the ball 44 is simply forced downwardly in ball cage insert 72 to a valve seat to seal the valve. The lower shoulders 108 of the ball cage insert 72 rest upon the inner ring of the upper ball cage body 74 as represented by the shoulders 104 and 106 in FIGS. 8 and 9.

Thus, there has been disclosed a novel side intake valve assembly for use in a subterranean well for pumping water that is separated from a hydrocarbon downwardly into the well into a water stratum or zone. The side intake valve assembly itself is used in conjunction with a second or lower valve assembly and a hollow connecting body connecting the lower end of the side intake valve assembly to the upper end of the second or lower valve assembly.

The first or side intake valve assembly includes a first housing having an upper end and a lower end, a first one-way gravity operated ball valve located between the upper and lower ends in the first housing, a water intake body coupled to the lower end of the first housing and having a side intake port in fluid connection with the water in the subterranean well such that the water can be pumped from the casing through the first one-way gravity operated ball valve and at least one longitudinal passageway in the first housing to the lower end such that water above the first housing can be transferred to an area below the first housing.

The corresponding structures, materials, acts, and equivalents of all means or step plus function elements in the claims below are intended to include any structure, material, or act for performing the function in combination with other claimed elements as specifically claimed.

I claim:

1. A side intake valve assembly for use in a subterranean well having a well casing and a production tubing string within said well casing that forms an annuls for receiving a production fluid including a hydrocarbon fluid and water from a production zone and having a water disposal zone and a pump associated with the production tubing string for pumping said hydrocarbon fluid from said production zone to the surface and water to said water disposal zone, said side intake valve assembly comprising:

a housing including an upper end for coupling to said production tubing string and a lower end, said housing spaced below said pump;

a single one-way gravity operated valve located in said housing between said upper and lower ends and having an unobstructed outlet path into said housing;

a fluid intake body having a top coupled to the lower end of said housing and a bottom and having a side intake port in fluid communication with said water in said annulus such that said water can be pumped from said annulus and through said single one-way gravity operated valve into said housing; and at least one longitudinal passageway in said fluid intake body extending from the top end to the bottom such that water above said housing can be transferred below said housing.

2. A side intake valve assembly as in claim 1 wherein said one-way gravity operated valve comprises:

a spherical mass; and a valve seat for receiving the spherical mass in sealing relationship by force of gravity, said spherical mass moving away from said valve seat to open said valve when pump forces oppose and overcome said gravity and said spherical mass is held in sealing relationship to said valve seat when said pump forces aid said gravity.

3. A side intake valve assembly as in claim 2 further including:

a metal ball as said spherical mass that engages said valve seat by gravity to hold said gravity operated valve in a normally closed position.

4. A side intake valve assembly as in claim 3 wherein said one-way gravity-operated valve further comprises:

a ball cage insert surrounding and limiting movement of said metal ball away from said valve seat;

a ball cage body having an upper portion and a lower portion coupled to said fluid intake body, and a central portion receiving said ball cage insert; and an adapter bushing having a lower portion for matingly engaging the upper portion of the ball cage body to contain said metal ball and ball cage insert.

5. A side intake valve assembly as in claim 1 wherein said valve assembly housing and said production tubing have the same outer diameter.

6. A side intake valve assembly as in claim 1 further including a threaded upper end on said valve assembly housing for attaching to a production tubing string.

7. A side intake valve assembly as in claim 1 wherein the fluid intake body having the side intake port has an outer diameter equal to the outer diameter of said valve assembly housing.

8. The valve assembly of claim 1 wherein said upper end of said housing is releasably coupled to said production tubing.

9. The valve assembly of claim 8 wherein said fluid intake body is releasably coupled to said gravity operated valve.

10. The valve assembly of claim 1 wherein said fluid intake body is releasably coupled to said gravity operated valve.

11. The valve assembly of claim 1 and further comprising a second valve assembly releasably coupled to said bottom of said fluid intake body such that water in said water disposal zone cannot flow back to said intake valve assembly.

12. A side intake valve assembly for use in a subterranean well having a well casing and a production tubing string within said well casing for forming a water-containing annulus and including a fluid pump located above said side intake valve assembly, said side intake valve assembly comprising:

a body portion having an upper end and a lower end;

a side orifice in said body portion lower end for receiving water from said annulus;

a single normally closed gravity operated valve within said body portion and coupled to the side orifice for allowing water from said annulus to flow under pressure through said valve and then through an unobstructed path to the interior of said body portion upper end and preventing water flow in the opposite direction; and at least one longitudinal bypass passageway in said body portion coupling said body portion upper end to said lower end for allowing water flow between the upper end and the lower end of said body portion such that said pump can force water to flow from said upper end of said body portion to said lower end through said at least one longitudinal bypass passageway.

13. A side intake valve assembly for use with a production tubing string in a subterranean well producing a production fluid including a hydrocarbon fluid and water from a producing zone and having a water disposal zone, said production tubing string including a pump for pumping said hydrocarbon fluid from said production zone to the surface and water to said water disposal zone, the side intake valve assembly comprising:

a coupling having an hollow interior and threaded upper and lower ends, said upper end for coupling to said production tubing string in said fluid producing well, said coupling located below said pump;

a water intake body having a hollow interior, an outer circumference, and threaded upper and lower ends, the threaded upper end being threadedly connected to said lower end of said coupling;

said water intake body having a side intake orifice in said outer circumference for carrying water from said producing well to the hollow interior of said water intake body;

a single gravity operated valve in said water intake body in water receiving engagement with said side intake orifice for enabling said water from said producing well to freely pass only toward the upper end of said coupling; and at least one longitudinal by-pass passageway in said water intake body coupling the upper and lower ends for allowing water to flow from the upper end of said water intake body to the lower end thereof.

14. A side intake valve assembly as in claim 13 wherein said gravity operated value further includes:

a spherical mass; and a valve seat for receiving said spherical mass in sealing relationship by force of gravity, said spherical mass moving away from said valve seat to open said valve when pump pressure opposes and overcomes said gravity and is held in sealing relationship to said valve seat when said pump pressure aids said gravity.

15. A side intake valve assembly as in claim 14 further including:

a metal ball as said spherical mass;

a ball cage insert surrounding and limiting movement of said metal ball away from said valve seat;

a ball cage body having a lower portion for coupling to said fluid intake body and having a central portion receiving said ball cage insert, said upper ball cage body having an upper portion; and a hollow ball cage insert adapter bushing having a lower portion for matingly connecting to said upper portion of said ball cage insert to contain said ball and said ball cage insert in said ball cage body.

* * * * *